US006335721B1

(12) United States Patent
Jeong

(10) Patent No.: US 6,335,721 B1
(45) Date of Patent: Jan. 1, 2002

(54) LCD SOURCE DRIVER

(75) Inventor: Kwoan-Yel Jeong, Kongsangbuk-do (KR)

(73) Assignee: Hyundai Electronics Industries Co., Ltd., Kyoungki-Do (KR)

( * ) Notice: Subject to any disclaimer, the term of this patent is extended or adjusted under 35 U.S.C. 154(b) by 0 days.

(21) Appl. No.: 09/277,191

(22) Filed: Mar. 26, 1999

(30) Foreign Application Priority Data

Mar. 27, 1998 (KR) ..... 98-10687

(51) Int. Cl.[7] ..... G09G 3/36

(52) U.S. Cl. ..... 345/100; 345/98; 345/99; 345/96

(58) Field of Search ..... 345/98, 99, 100, 345/96

(56) References Cited

U.S. PATENT DOCUMENTS 5,192,945 A * 3/1993 Kusada ..... 340/784
5,578,957 A 11/1996 Erhart et al. ..... 327/333
5,973,658 A * 10/1999 Kim et al. ..... 345/92
6,008,801 A * 12/1999 Jeong ..... 345/204

* cited by examiner

*Primary Examiner*—Richard Hjerpe
*Assistant Examiner*—Jean Lesperance

(74) *Attorney, Agent, or Firm*—Morgan, Lewis & Bockius LLP

(57) ABSTRACT

An LCD source driver having a plurality of driving channels includes a control logic responsive to an internal polarity control signal, a first clock signal and a second clock signal, the control logic being inputted alternately and consecutively with digital video signals of multiple bits including odd channel digital video signals and even channel digital video signals, the control logic generating the odd channel digital video signals and the even channel digital video signals corresponding to a logic value of the internal polarity control signal in one of an inputted order and a reversed order, a shift register being activated successively and outputting a plurality of enabling signals, a latch block having a plurality of latches for receiving the odd channel digital video signals and the even channel digital video signals synchronized by enabling signals, the latch block generating simultaneously the odd channel digital video signals and the even channel digital video signals when the enabling signals are activated, a negative polarity video signal processor for converting the odd channel digital video signals outputted from the latch block into negative polarity analog video signals having a voltage lower than a common voltage and increased current driving capacity, a positive polarity video signal processor for converting the even channel digital video signals outputted from the latch block into positive polarity analog video signals having a voltage higher than the common voltage and having a higher current driving capacity, and a switching block having a plurality of switching circuits for receiving the negative polarity analog video signals and the positive polarity analog video signals.

20 Claims, 9 Drawing Sheets

FIG. 1
RELATED ART

Channel

| Row | 1 ODD | 2 EVEN | 3 ODD | 4 EVEN | 5 ODD | 6 EVEN | 7 ODD | 8 EVEN | 9 ODD |
|---|---|---|---|---|---|---|---|---|---|
| ODD | − | + | − | + | − | + | − | + | − |
| EVEN | + | − | + | − | + | − | + | − | + |
| ODD | − | + | − | + | − | + | − | + | − |
| EVEN | + | − | + | − | + | − | + | − | + |
| ODD | − | + | − | + | − | + | − | + | − |
| EVEN | + | − | + | − | + | − | + | − | + |

LCD SOURCE DRIVER

This application claims the benefit of Korean patent application No. 98-10687, filed Mar. 27, 1998, which is hereby incorporated by reference.

BACKGROUND OF THE INVENTION

1. Field of the Invention

The present invention relates to a liquid crystal display (LCD) source driver with increased current driving capacity for driving the LCD and converting digital video signals into positive and negative analog video signals for a dot inversion method.

2. Discussion of the Related Art

Video signals that do not have a constant polarity, but are inverted alternately, are supplied to an LCD because the expected life span of each liquid crystal cell of the LCD is shortened by a constant application of the video signals having a fixed polarity.

A source driver converts digital video signals into negative and positive polarity digital video signals, which are lower and higher in voltage, respectively, than the common voltage Vcom. The source driver converts the digital video signals to analog video signals of higher current driving capacity, and supplies each liquid crystal cell with the analog video signals. In general, the common voltage Vcom has a set point of 5V, the positive polarity video signals have a voltage range of 5 to 10V, and the negative polarity video signals have a voltage range of 0 to 5V.

There are several inversion methods, such as a line inversion method, a column inversion method and a dot inversion method, for driving an LCD panel with an LCD source driver. In the line inversion method, an LCD having a matrix-structured cell array is inverted alternately by row, and the polarities of the video signals applied to each odd and even rows are inverted alternately. In the column inversion method, where the LCD is inverted by column, and the polarities of the video signals applied to each odd and even columns of the LCD are alternately inverted.

However, flicker may occur in an LCD using the line or column inversion method when two adjacent rows or columns are alternately inverted. Thus, the dot inversion method, which mixes the line inversion method with the column inversion method, is used.

FIG. 1 shows polarities of video signals supplied to each cell of LCD driven by the dot inversion method. Referring to FIG. 1, flicker can be greatly reduced by having the polarities of the LCD cells differ from one another both vertically and horizontally. The dot inversion method, which applies mainly to high quality image displays in the LCDs, is becoming more prevalent in fields such as TV's, computer monitors, and the like.

FIG. 2 is a block diagram of an LCD source driver according to the related art, which shows the components necessary for driving only one channel. Referring to FIG. 2, 4 bits of digital video signals 40 to 43, and a polarity control signal 44, which controls the polarities of the digital video signals 40 to 43, are inputted. The digital video signals having voltage levels of Vss to Vdd are converted to the positive polarity analog video signals of Vss1 to Vdd1 through a positive polarity video signal generating path 48 formed by a level shifter 46, a D/A converter 54 and a sample and hold circuit 56.

The digital video signals having voltage levels Vss to Vdd are converted to the negative polarity analog video signals of Vss1 to Vdd1 range through a negative polarity video signal generating path 52 formed by another level shifter 50, another D/A converter 68 and another sample and hold circuit 70. The converted positive and negative analog video signals are inputted to an output buffer 64.

The polarity control signal 44 is converted to output control signals 30 and 34 controlling the output operation of the output buffer 64 through a pair of level shifters 28 and 32, and then the output control signals 30, 34 are applied to the output buffer 64. The output buffer 64 (a type of multiplexer) selects either the negative or positive polarity video signal, which is inputted through the positive polarity video signal generating path 48 and the negative polarity video signal generating path 52, by the output control signals 30 and 34, which control the output buffer 64 according to the polarities of the video signals supplied to the LCD cells.

The positive or negative polarity analog video signal outputted from the output buffer 64 drives a channel of an LCD. Namely, two video signal generating paths of the negative and positive polarity are required to drive a single channel, which causes an increase in a layout area of a chip due to an increased number of elements of the driver circuit.

FIG. 3 shows a circuit of an output buffer of an LCD source driver according to the related art. The positive polarity video signals are transferred to an output terminal 66 through two PMOS transistors Q1 and Q2 connected in series. A gate of the PMOS transistor Q1 is controlled by the output control signal 30. The negative polarity video signals are transferred to the output terminal 66 through two NMOS transistors Q3 and Q4 connected in series. The PMOS transistor Q2 and the NMOS transistor Q4 protect the PMOS transistor Q1 and the NMOS transistor Q3 from the high voltage Vdd2 and the low voltage Vss at the output terminal.

However, a maximum voltage level Vdd1 of the positive polarity video signals or a minimum voltage level Vss2 of the negative polarity video signals is applied between sources and drains of the protecting devices of the PMOS transistor Q2 and the NMOS transistor Q4 at the moment that the positive and negative polarity video signal are outputted alternately from the output buffer 64. Such a high voltage applied instantly to the protecting devices decreases the life spans of the protecting devices.

SUMMARY OF THE INVENTION

Accordingly, the present invention is directed to an LCD source driver that substantially obviates one or more of the problems due to limitations and disadvantages of the related art.

An object of the present invention is to provide an LCD source driver with a reduced number of components.

Another object of the present invention is to provide an LCD source driver which prevents protecting devices in an output terminal of an output buffer from receiving high voltage instantaneously due to a voltage difference between the negative polarity video signal and a positive polarity video signal.

Additional features and advantages of the invention will be set forth in the description which follows and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, in accordance with one aspect of the present invention there is provided an LCD source driver having a plurality of driving channels including a control logic responsive to an internal polarity control signal, a first clock signal and a second clock signal, the control logic being inputted alternately and consecutively with digital video signals of multiple bits including odd channel digital video signals and even channel digital video signals, the control logic generating the odd channel digital video signals and the even channel digital video signals corresponding to a logic value of the internal polarity control signal in one of an inputted order and a reversed order, a shift register being activated successively and outputting a plurality of enabling signals, a latch block having a plurality of latches for receiving the odd channel digital video signals and the even channel digital video signals synchronized by the plurality of enabling signals, the latch block generating simultaneously the odd channel digital video signals and the even channel digital video signals when the enabling signals are activated, a negative polarity video signal processor for converting the odd channel digital video signals outputted from the latch block into negative polarity analog video signals having a voltage lower than a common voltage and increased current driving capacity, a positive polarity video signal processor for converting the even channel digital video signals outputted from the latch block into positive polarity analog video signals having a voltage higher than the common voltage and having a higher current driving capacity, and a switching block having a plurality of switching circuits for receiving the negative polarity analog video signals and the positive polarity analog video signals, wherein odd switching circuits of the switching block generate the positive polarity analog video signals on HIGH of the internal polarity control signal and the negative polarity analog video signals on LOW of the internal polarity control signal, and wherein even switching circuits of the switching block generate the negative polarity analog video signals on HIGH of the internal polarity control signal and the positive polarity analog video signals on LOW of the internal polarity control signal.

It is to be understood that both the foregoing general description and the following detailed description are exemplary and explanatory and are intended to provide further explanation of the invention as claimed.

BRIEF DESCRIPTION OF THE ATTACHED DRAWINGS

The accompanying drawings, which are included to provide a further understanding of the present invention are incorporated in and constitute a part of this application, illustrate embodiments of the invention and together with the description serve to explain the principle of the invention.

In the drawings:

FIG. 1 shows polarities of video signals supplied to each cell of an LCD driver by a dot inversion method;

DETAILED DESCRIPTION OF PREFERRED EMBODIMENTS

Reference will now be made in detail to the preferred embodiments of the present invention, examples of which are illustrated in the accompanying drawings.

Figure 2:
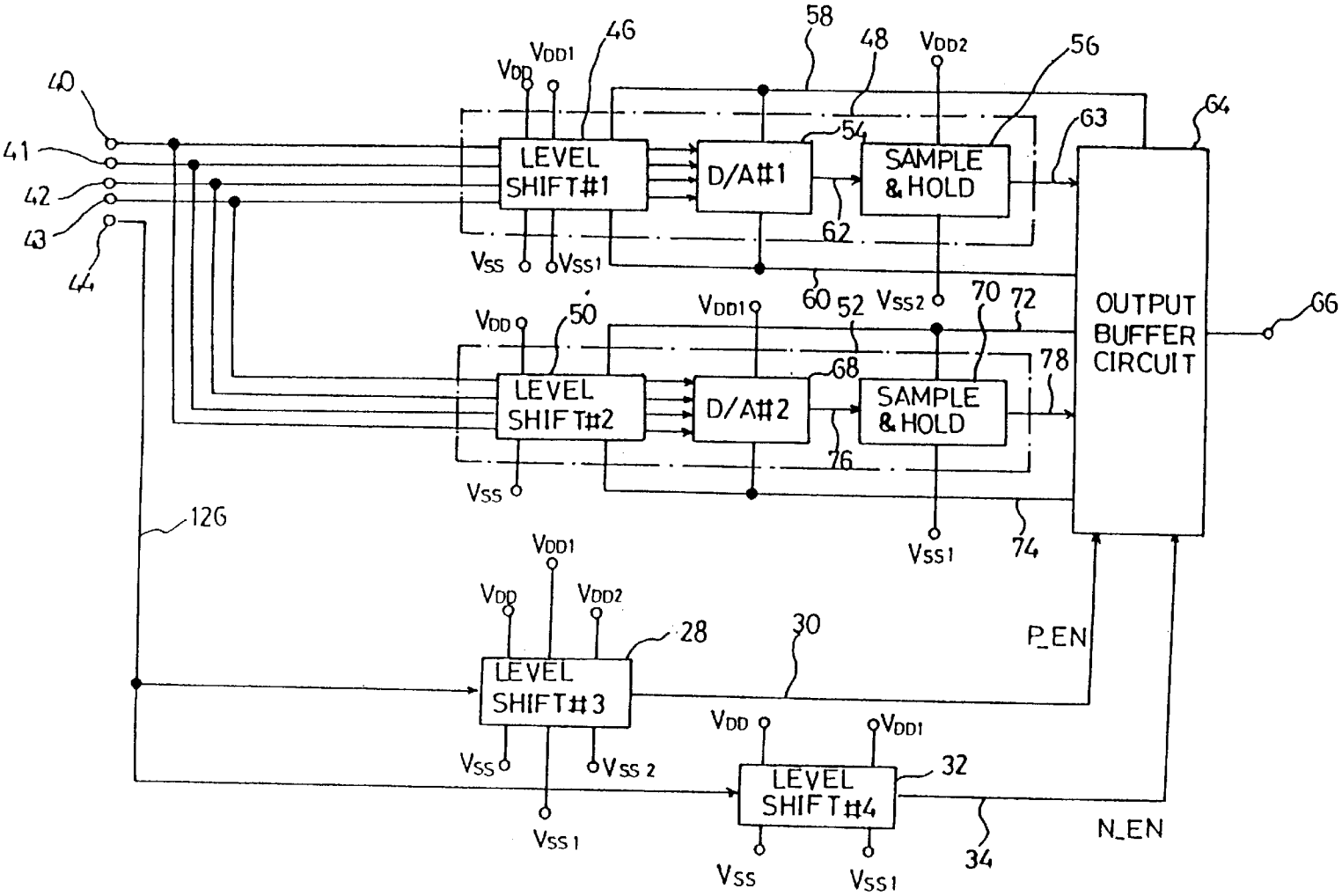
FIG. 2 RELATED ART
FIG. 2 is a block diagram of the LCD source driver according to the related art.
Figure 3:
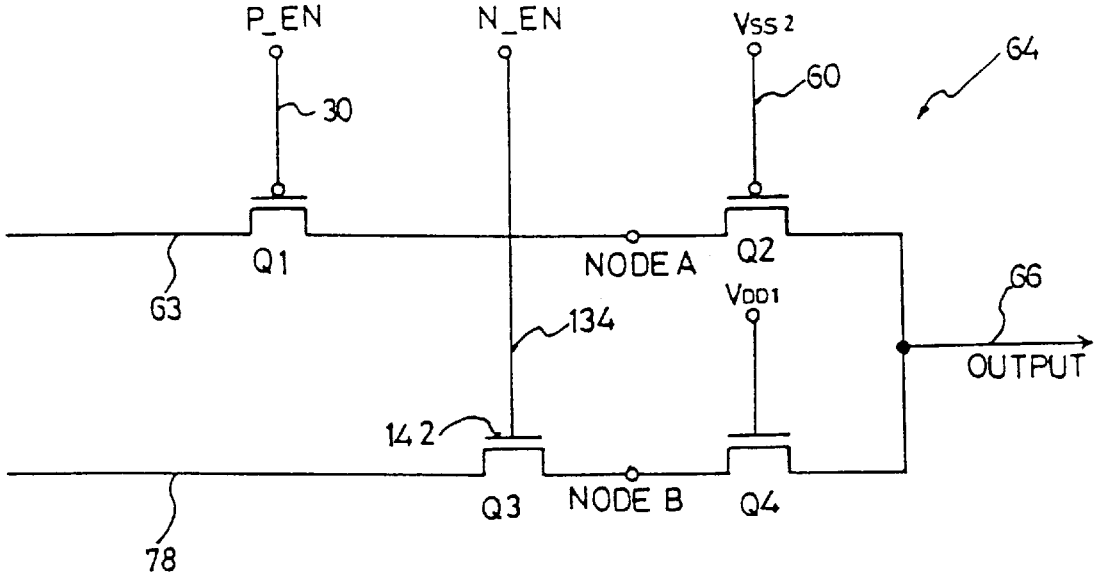
FIG. 3 RELATED ART
FIG. 3 shows a circuit of an output buffer of the LCD source driver according to the related art.
Figure 4:
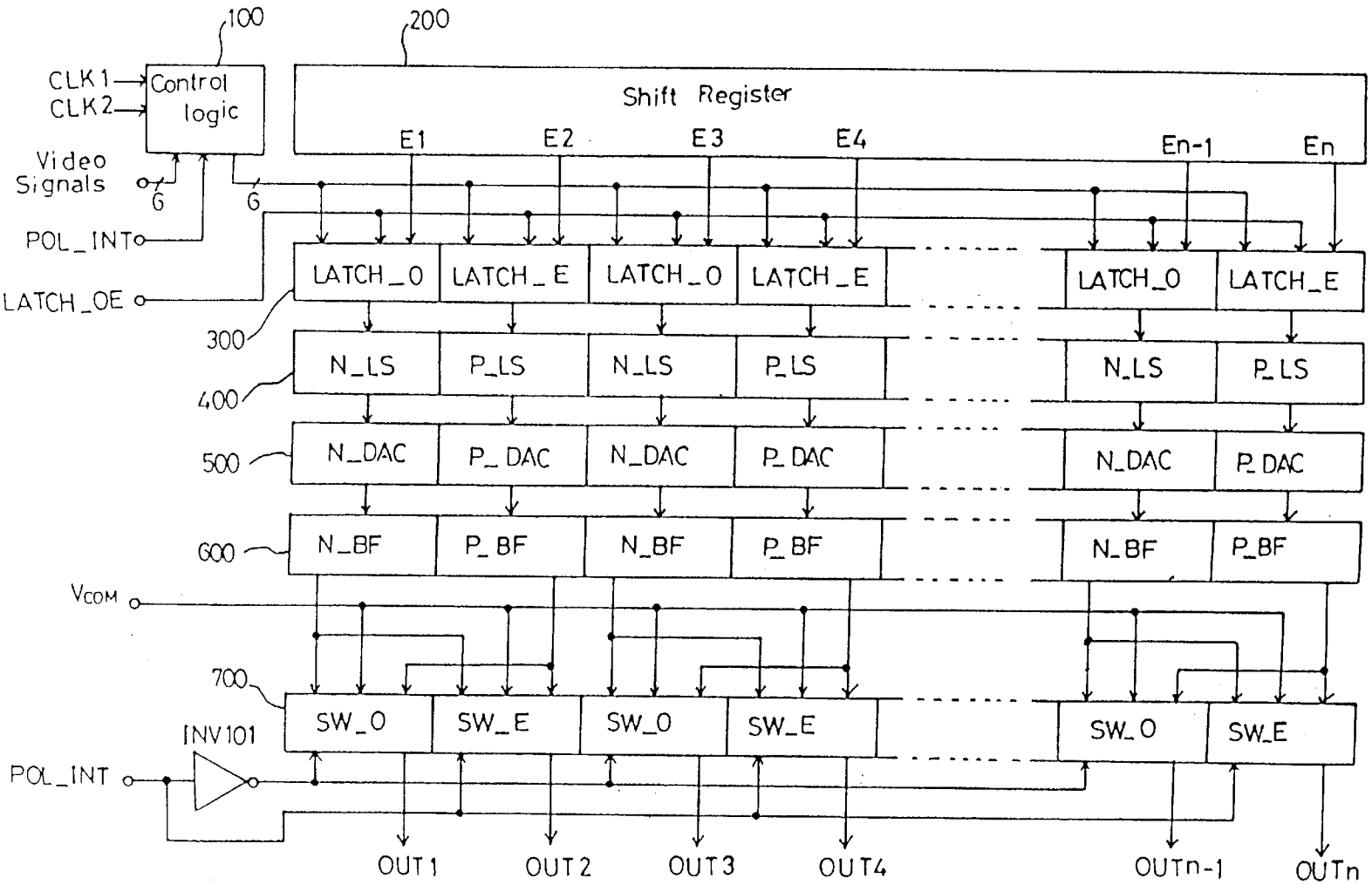
FIG. 4 is a block diagram of an LCD source driver according to the present invention.

FIG. 4 is a block diagram of an LCD source driver according to the present invention. As shown in FIG. 4, an internal polarity control signal POL_INT and two clock signals CLK1 and CLK2 are inputted to a control logic 100. The ratio of periods of the two clock signals CLK1 and CLK2 is 1 to 2. In other words, the period of the clock signal CLK2 is twice as long as that of the clock signal CLK1. Digital video signals including odd channel digital video signals of 6 bits and even channel digital video signals including 6 bits are inputted to the control logic 100 alternately and consecutively.

Figure 5:
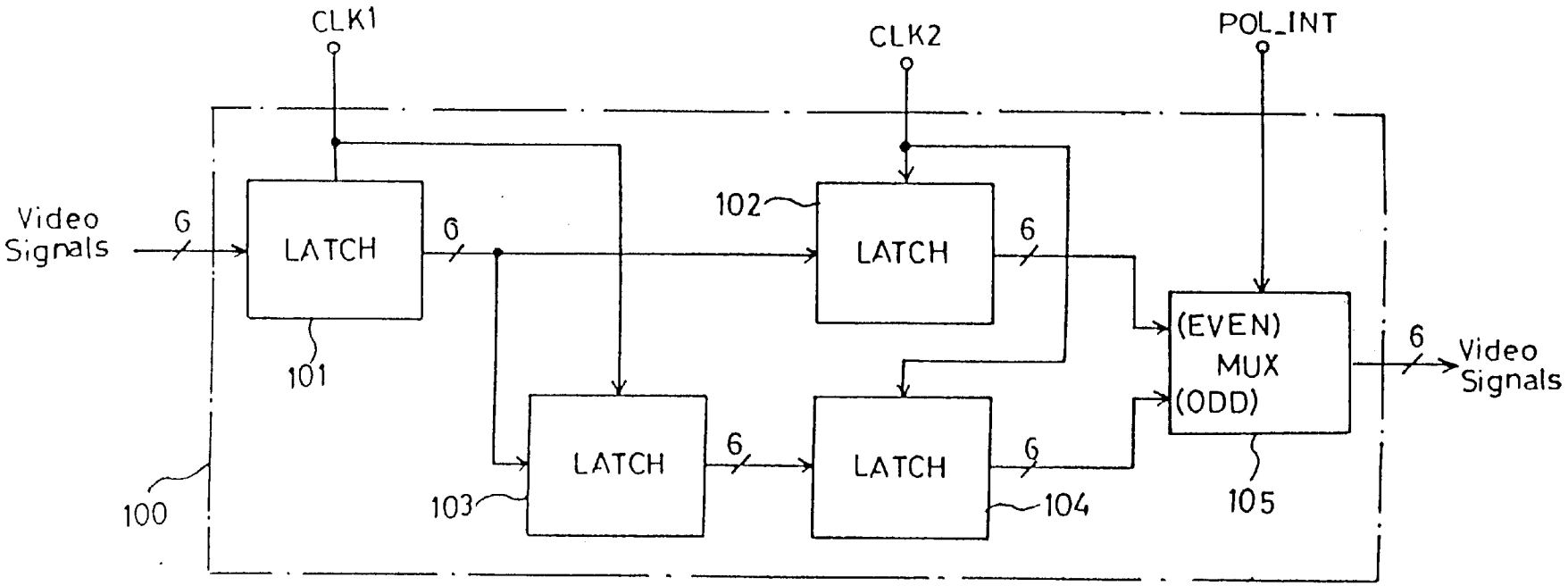
FIG. 5 is a block diagram of control logic of the LCD source driver according to the present invention.

FIG. 5 is a block diagram of control logic 100 in an LCD source driver according to the present invention. Referring to FIG. 5, the control logic 100 includes four 6-bit latches 101–104 and a multiplexer 105. Each of the 6-bit latches 101 to 104 processes 6-bit digital video signals.

The multiplexer 105 has EVEN and ODD input terminals, each of which is 6 bits wide. The multiplexer 105 selects one of the EVEN and ODD input terminals and then generates signals of 6 bits only, wherein the internal polarity control signal POL_INT is used as a selection signal of the multiplexer 105. The video signals of the ODD input terminal are generated if the logic value of the internal polarity control signal is 0, i.e., LOW. On the other hand, the video signals of the EVEN input terminal are outputted when the logic value is 1, i.e., HIGH.

In the control logic 100, the operations for inputting the video signals to the latch 101 and outputting them through the multiplexer 105 are as follows.

Two periods of the clock signal CLK1 are required until the odd channel video signal inputted to the latch 101 has been inputted to the latch 104 via the latch 103. The input/output operations of the video signal occur twice in the latches 101 and 103 during two clock periods. Hence, during two periods of the clock signal CLK1, the odd channel video signal is inputted to the latch 104, while the succeeding even channel video signal is inputted to the latch 103.

However, during these two periods of the clock signal CLK1, only a single input/output operation occurs in the latch 102 since the period of the clock signal CLK2 is twice as long as that of the clock signal CLK1. The even channel video signal has already been inputted to the latch 101 before the latch 102 is ready to receive a new video signal on a transition of the clock signal CLK2 to LOW.

After these operations have been repeated, the video signals supplied from the latch 104 to the multiplexer 105 become odd channel video signals, and the video signals supplied from the latch 102 to the multiplexer 105 become even channel video signals. The odd channel video signal having been inputted to the latch 104 and the even channel video signal having been inputted to the other latch 102 are inputted simultaneously to the EVEN and ODD input terminals of the multiplexer 105 on a transition of the clock signal CLK2 to HIGH. From the multiplexer 105, the odd channel video signals of the ODD input terminal and the even channel video signals of the EVEN input terminal are generated alternately by the internal polarity control signal POL_INT having the same period as the clock signal CLK2.

The internal polarity control signal POL_INT comes from an outer polarity control signal POL inputted to the source driver. The outer polarity control signal POL has a period which is twice as long as the period of a gate driving signal outputted from a gate driver in LCD. Accordingly, the outer polarity control signal POL is either HIGH or LOW when the gate driver drives a row (a line) of the LCD. The outer polarity control signal POL has a new level that is different from the previous state, i.e., either LOW or HIGH, when the gate driver drives the next row.

Figure 6A:
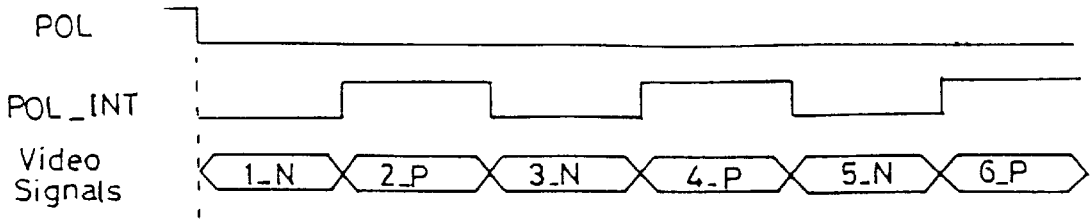
FIGS. 6A and 6B show timing diagrams of input and output signals of the control logic shown in FIG. 4.
Figure 6B:
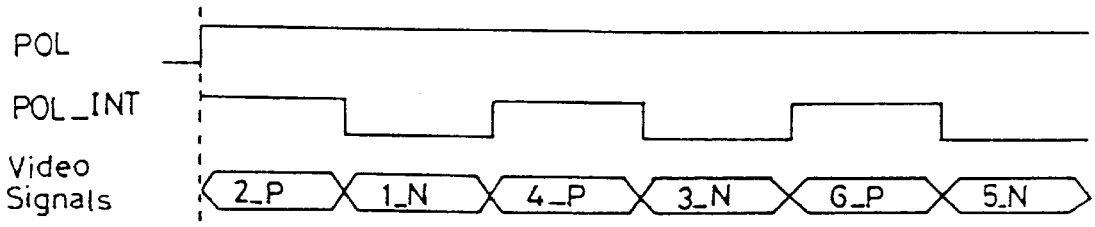

FIGS. 6A and 6B show timing diagrams of input and output signals of the control logic 100 shown in FIG. 4, where the relationship between the outer polarity control signal POL and the internal polarity control signal POL_INT is illustrated. Referring to FIGS. 6A and 6B, the internal polarity control signal POL_INT has different phases according to the levels of the outer polarity control signal POL. Namely, the internal polarity control signal POL_INT becomes a pulse signal starting from HIGH interval as soon as the outer polarity control signal POL goes from LOW to HIGH as shown in FIG. 6B. On the other hand, the internal polarity control signal POL_INT becomes a pulse signal starting from LOW interval when the outer polarity control signal/POL goes from HIGH to LOW as shown in FIG. 6A.

FIGS. 6A and 6B also show the outputted video signals whose states vary according to the states of the internal polarity control signal POL_INT. The order of the inputted video signals is identical to that of the outputted video signals once the outer polarity signal POL becomes LOW and the internal polarity control signal POL_INT starts from LOW. However, the order of the outputted signals is changed once the outer polarity control signal POL becomes HIGH, and the internal polarity control signal POL_INT starts from HIGH.

In other words, when the outer polarity control signal POL is LOW, the odd channel video signal from the input terminal ODD is generated first, and then the even channel video signal of the EVEN input terminal follows because the internal polarity control signal POL_INT also starts from LOW to keep the order of the video signals that have been inputted to the latch 101.

HIGH interval of the internal polarity control signal POL_INT starts first once the outer polarity control signal POL goes from LOW to HIGH. Thus, the even channel video signal of the EVEN input terminal is generated first and then the odd channel video signal is outputted, which is opposite to the order of video signals inputted to the latch 101. The order of video signals output from the multiplexer 105 may be selected with the internal polarity control signal POL_INT.

The digital video signals generated alternately from the control logic 100 in FIG. 4 are inputted to latches LATCH_O and LATCH_E of a latch block 300, in order, by n enabling signals E1 to En outputted in turn from a shift register 200 of an input circuit. The latch block 300 includes the odd latch LATCH_O to which the odd channel video signals are inputted, and the even latch LATCH_E to which the even channel video signals are inputted.

A video signal processor includes a negative polarity video signal processor and a positive polarity video signal processor, each of which further includes a level shifter block 400, a D/A converter block 500 and a buffer block 600. These three elements are divided into the negative polarity video signal processor and the positive polarity video signal processor because each element includes parts of processing negative signals and positive signals.

The level shifter block 400 includes a negative polarity level shifter N_LS and a positive polarity level shifter P_LS. After receiving digital video signals outputted from the odd latch LATCH_O of the latch block 300, the negative polarity level shifter N_LS generates negative polarity digital video signals whose voltage levels are shifted down to a range between the common voltage Vcom of 5V and 0V. After receiving video signals outputted from the even latch LATCH_E of the latch block 300, the positive polarity level shifter P_LS generates positive polarity digital video signals whose voltage levels are shifted up to a range between the common voltage Vcom and 10V.

The D/A converter block 500 also includes a negative polarity D/A converter N_DAC and a positive polarity D/A converter P_DAC. After receiving the negative polarity digital video signals outputted from a negative polarity shift register N_LS, the negative polarity D/A converter N_DAC generates negative polarity analog video signals. The positive polarity D/A converter P_DAC converts positive polarity digital video signals into positive polarity analog video signals.

The buffer block 600 includes a negative polarity buffer N_BF and a positive polarity buffer P_BF. Each buffer is a unity voltage gain current amplifier. The negative polarity buffer N_BF receives negative analog video signals from the negative polarity D/A converter N_DAC, and then regenerates the analog video signals of the same voltage and higher current driving capacity.

As explained above, a series of video signal processing paths including the level shifter block 400, the D/A converter block 500 and the buffer block 600 are divided into the negative polarity video signal processor and the positive polarity video signal processor.

A switching block 700 restores the order of the odd channel video signals and the even channel video signals which were outputted from the control logic 100 in reverse order. The switching block 700 includes switching circuits SW_O and SW_E, to which all of the negative and the positive polarity video signals from the negative and the positive polarity video signal processor, respectively, are inputted. The odd switching circuit SW_O receives both the negative and positive analog video signals outputted from the adjacent buffers N_BF and P_BF. The even switching circuit SW_E also receives the negative and the positive analog video signals outputted from the buffers N_BF and P_BF, which are the same signals as those inputted to the odd switching circuit SW_O. Namely, the odd and the even switching circuit SW_O and SW_E both operate on the analog video signals which have different polarities and which are outputted from a pair of the buffers of positive and negative polarity. The common voltage Vcom is applied to the switching circuits SW_O and SW_E. The internal polarity control signals POL_INT and /POL_INT are inputted as output control signals. However, the phases of the internal polarity control signals POL_INT and /POL_INT inputted to the odd switching circuit SW_O and the even switching circuit SW_E are opposite. The inverted internal polarity control signal /POL_INT inverted by an inverter INV101 is inputted to the odd switching circuit SW_O, while the internal polarity control signal POL_INT, which is unchanged, is inputted to the even switching circuit SW_E.

Video signals outputted from one of switching circuits SW_O and SW_E drive one of the channels in LCD. The odd switching circuit SW_O outputs positive analog video signals when the internal polarity control signal POL_INT is HIGH, but outputs negative analog video signals when the internal polarity control signal POL_INT is LOW. The even switching circuit SW_E outputs negative analog video signals when the internal polarity control signal POL_INT is HIGH, but outputs positive analog video signals when the internal polarity control signal POL_INT is LOW.

Figure 7:
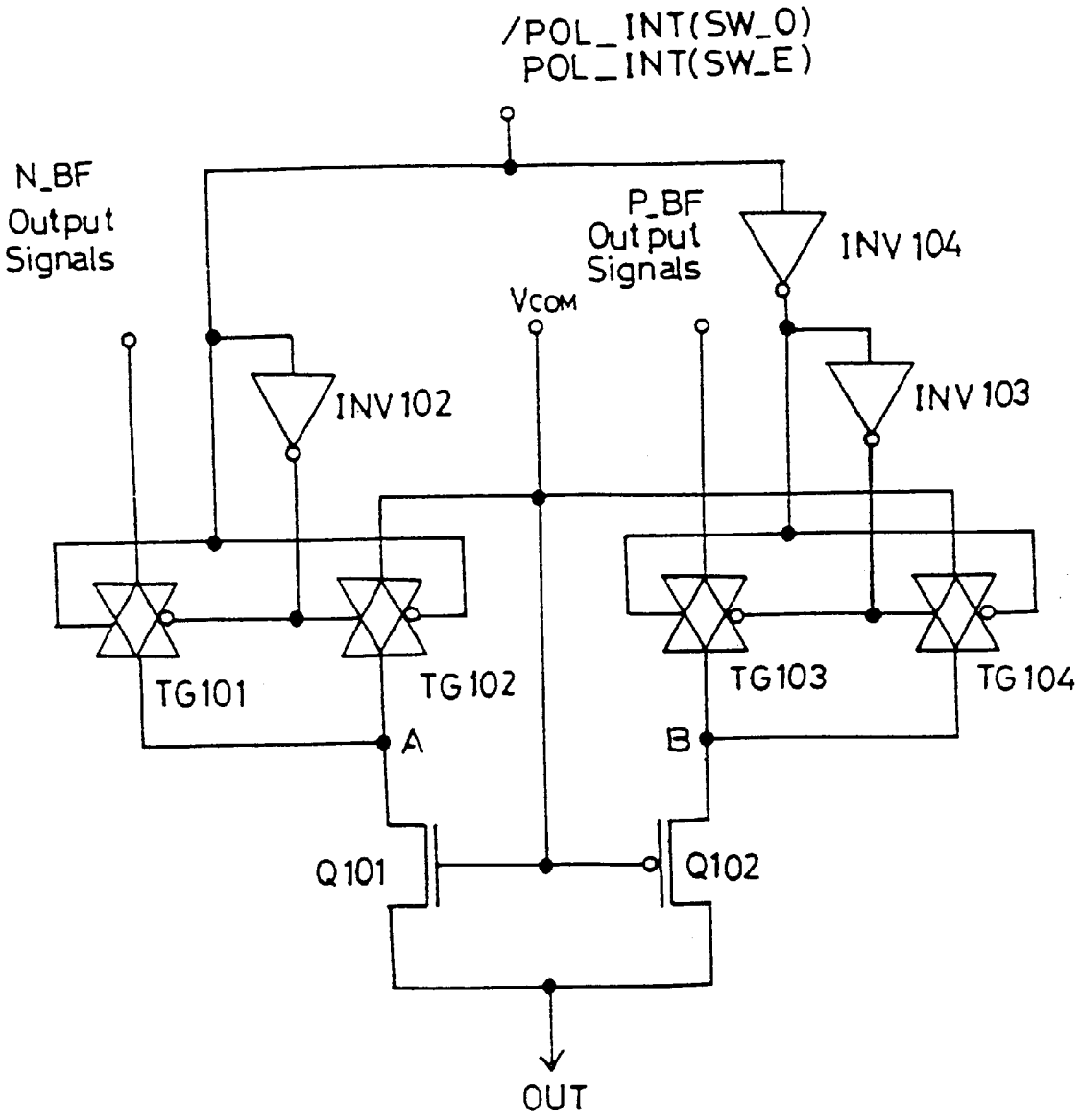
FIG. 7 is a switching circuit according to the present invention.

FIG. 7 shows a detailed schematic of a switching circuit according to the present invention. The major elements of the switching circuit are four transmission gates TG101 to TG104, and an NMOS transistor Q101 and a PMOS transistor Q102 as protecting devices. The odd and even switching circuits SW_O and SW_E are the same as in the description above. The only difference between the switching circuits SW_O and SW_E is that they are controlled by the internal polarity control signals POL_INT and /POL_INT having opposite phases, which is shown in FIG. 7 relating to the phases of the internal polarity control signals POL_INT and /POL_INT inputted to each switching circuit.

Each switching circuit operates as the follows. Negative polarity analog video signals from the negative polarity buffer N_BF are inputted to the transmission gate TG101, while positive polarity analog video signals from the positive polarity buffer P_BF are inputted to the transmission gate TG103. The common voltage Vcom is applied to the transmission gates TG102 and TG104. The output signals from the transmission gates TG101 and TG102 are applied to a source of the NMOS transistor Q101. The output signals from the transmission gates TG103 and TG104 are applied to a source of the PMOS transistor Q102. An output terminal OUT is formed by connecting the drains of the NMOS and the PMOS transistor Q101 and Q102 together. The output signals of the output terminal OUT drive the channels of LCD.

The operation of the odd switching circuit SW_O differs from that of the even switching circuit SW_E. The odd switching circuit SW_O outputs negative analog video signals, and the even switching circuit SW_E generates positive analog video signals, or vice versa. Such outputting operations are achieved by inputting the inverted internal polarity control signal /POL_INT to the odd switching circuit SW_O and the (non-inverted) internal polarity control signal POL_INT to the even switching circuit SW_E. In order to drive a first row of the LCD, the inputted video signals are inputted to the latch in the control logic 100 without changing their input order.

The negative and the positive analog video signals generated through the negative and the positive polarity signal processors are outputted from the switching block 700 without changing their order. Such operations are achieved by setting the internal polarity signal POL_INT to LOW. Accordingly, the internal polarity control signal POL_INT becomes a pulse signal starting from LOW.

If the switching circuit of FIG. 7 is an odd switching circuit SW_O, the inverted internal polarity control signal /POL_INT is inputted to the odd switching circuit SW_O. When the internal polarity control signal POL_INT is LOW, the order of the output signals of the odd and the even channel video signals from the control logic 100 have the same order as the inputted signals. The video signal inputted first is converted into a negative polarity video signal of the odd channel if FIG. 1 is taken as a reference. Accordingly, when the internal polarity control signal POL_INT to be inputted is LOW, negative polarity analog video signals are outputted from the switching circuit in FIG. 7. The inverted internal polarity control signal/POL_INT is HIGH when the internal polarity control signal POL_INT is LOW. The HIGH of these signals turns on both transmission gates TG101 and TG104.

The PMOS transistor Q102 is turned off when there is no voltage difference between its gate and its source, because the common voltage Vcom is applied to the source through the transmission gate TG104. Negative polarity analog video signals, i.e., the output signals of the negative polarity buffer N_BF, are generated by the transmission gate TG101, and then applied to the source of the NMOS transistor Q101. The NMOS transistor Q101, which has been turned on by the voltage difference between its gate and its source, generates the negative polarity analog video signals, since the common voltage Vcom is applied to the gate of the NMOS transistor Q101, where the voltage difference between the gate and the source arises from the common voltage Vcom and the voltage of the negative polarity analog video signal.

Under the same conditions (i.e., the internal polarity control signal POL_INT starts from LOW), the output signal should be a positive polarity analog signal if the switching circuit in FIG. 7 is the even switching circuit SW_E. The LOW internal polarity control signal POL_INT is directly inputted to the even switching circuit SW_E, which turns on the transmission gates TG102 and TG103. The transmission gate TG102 carries the common voltage Vcom to the source of the NMOS transistor Q101 as well as to the gate of the NMOS transistor. Thus, the NMOS transistor Q101 is turned off, since there is no voltage difference between the gate and the source.

However, the transmission gate TG103 carries the positive polarity analog video signals to the source of the PMOS transistor Q102. The voltage difference between the positive polarity analog video signal and the common voltage Vcom occurs between the gate and the source of the PMOS transistor Q102, whose gate has the common voltage Vcom applied to it. Thus, the PMOS transistor Q102 is turned on to generate a positive polarity analog video signal.

Hence, the internal polarity control signal POL_INT becomes a pulse signal starting from LOW if the outer polarity control signal POL is LOW. The internal polarity control signal POL_INT generates signals in the control logic 100 and the switching block 700 without changing the order of input/output of video signals. Thus, the negative polarity analog video signals are transmitted to the odd channel and the positive polarity analog video signals are transmitted to the even channel. Therefore, the odd and the even channels in a row of the LCD are alternately driven by the video signals having opposite polarity.

In order to drive channels in a second EVEN row of an LCD, the positive polarity video signal drives odd channels, while the negative polarity video signal drives even channels. In this case, the positive and the negative polarity are switched with each other once the digital video signals to be inputted to the control logic 100 are transferred to the level shifter block 400 through the latch block 300. The level shifter block 400 reverses the polarities. Then, the video signals having opposite polarities compared to the actual required polarities are supplied to the LCD. Thus, the control logic 100 generates outputs by changing the order of signals that have been inputted, and the outer polarity control signal POL is HIGH. In this case, the internal polarity control signal POL_INT becomes a pulse signal starting from HIGH. The order of the outputs from the control logic 100 is changed by the internal polarity control signal POL_INT, wherein the outputs are the results of the inputted digital video signals. Video signals that drive the even channels are actually applied to the odd latch LATCH_O in the latch block 300, while the video signals that drive the odd channels are applied to the even latch LATCH_E.

The video signals inputted to the latch block 300 are converted to the negative and positive polarity analog video signals through the negative and the positive video signal converters, respectively. The negative polarity analog video signals from the negative video signal converter are inputted to the odd switching circuit SW_O, while the positive polarity analog video signals from the positive polarity video signal converter are inputted to the even switching circuit SW_E.

The switching block 700 restores the order of the video signals outputted from the control logic 100 to their original order. The process is as the follows.

If the switching circuit in FIG. 7 is the odd switching circuit SW_O, the inputted internal polarity control signal POL_INT is HIGH. In this case, the inverted internal polarity control signal/POL_INT is LOW, and the two transmission gates TG102 and TG103 are turned on. The NMOS transistor Q101, whose source has the common voltage Vcom applied to it through the transmission gate TG102, is turned off since there is no voltage difference between its gate and source.

The positive polarity analog video signals that are the output signals from the positive polarity buffer P_BF are supplied to the source of the PMOS transistor Q102 though the turned-on transmission gate TG103. The PMOS transistor Q102 is turned on to generate the positive polarity analog video signals since there is a voltage difference between the gate and the source due to the common voltage Vcom applied to the gate of the PMOS transistor Q102. The voltage difference between the gate and the source arises from the difference between the voltage of the positive polarity analog video signal and the common voltage Vcom.

When the internal polarity control signal starts from HIGH and the switching circuit in FIG. 7 is the even switching circuit SW_E, the inputted internal polarity control signal POL_INT is HIGH. When the internal polarity control signal POL_INT is HIGH, the transmission gates TG101 and TG104 are turned on. The PMOS transistor Q102 is turned off since there is no voltage difference between its gate and its source. In this case, the source of the PMOS transistor Q102 has the common voltage Vcom applied to it through the turned-on transmission gate TG104. The negative polarity analog video signals, which are the outputs of the negative polarity buffer N_BF, are supplied to the source of the NMOS transistor Q101 through the turned-on transmission gate TG101. The gate of the NMOS transistor Q101 has the common voltage Vcom applied to it. Thus, the NMOS transistor Q101 generates the negative polarity analog video signals since there is a voltage difference between its gate and its source. The voltage difference arises from the voltage of the negative polarity analog video signal and the common voltage Vcom.

Figure 8:
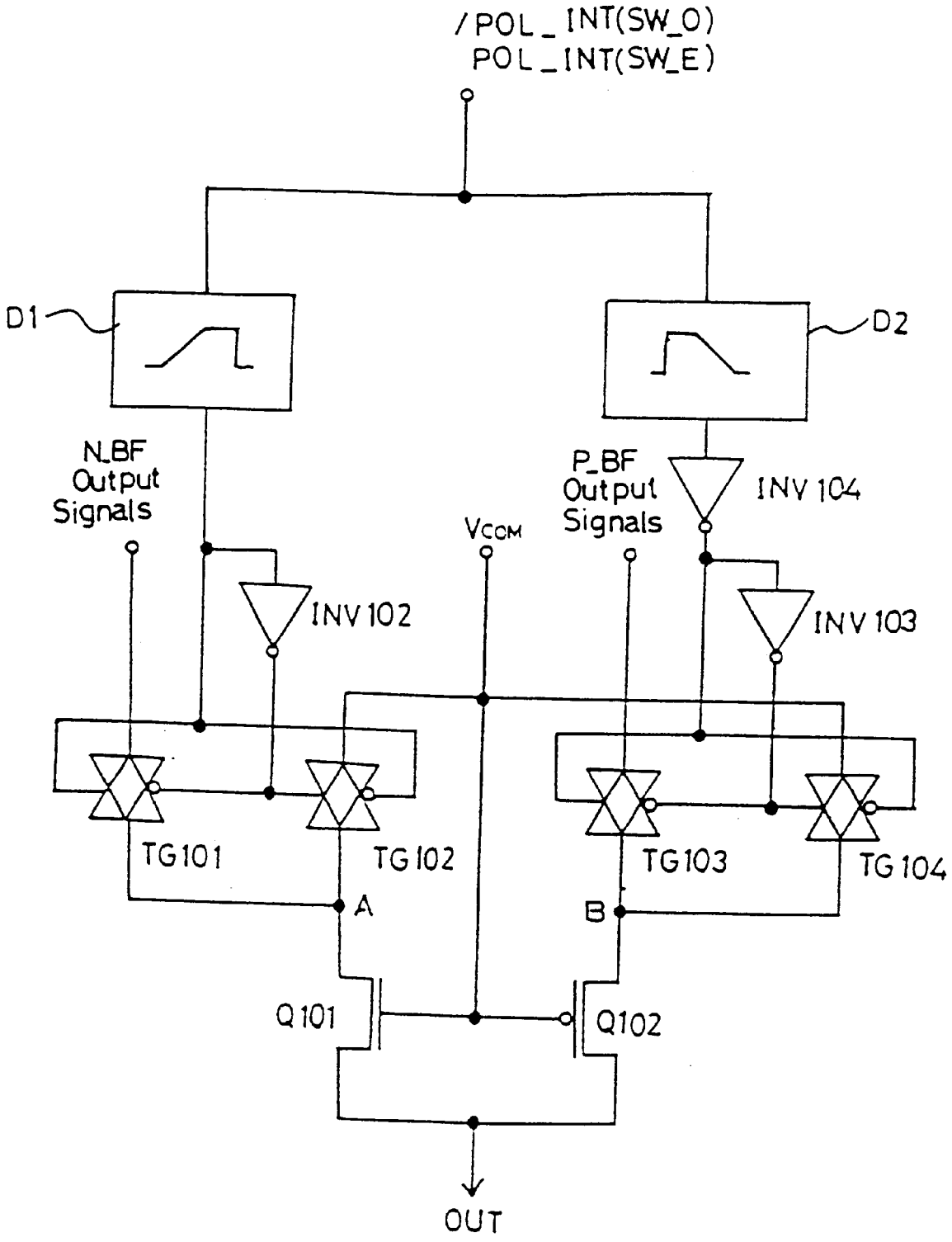
FIG. 8 shows input paths of polarity control signals inputted to the switching circuit according to the present invention.

FIG. 8 shows input paths of polarity-control signals inputted to the switching circuit according to the present invention, where the input paths of the internal polarity control signal POL_INT in the switching circuits SW_O and SW_E are connected to delay elements D1 and D2. The delay elements D1 and D2 increase logic transition time of the internal polarity control signals POL_INT and /POL_INT inputted to each switching circuits SW_O and SW_E.

The delay element D1 increases the rise time of the internal polarity control signal POL_INT by delaying a time when the internal polarity control signal POL_INT goes from LOW to HIGH. However, going from HIGH to LOW, the internal polarity control signal POL_INT falls without any time delay. Thus, when the internal polarity control signal POL_INT goes from LOW to HIGH, the HIGH signal is carried to the transmission gates TG101 and TG102 after a certain elapsed time. The delay element D2 increases the fall time of the internal polarity control signal POL_INT by delaying a time when the internal polarity control signal POL_INT goes from HIGH to LOW. However, going from LOW to HIGH, the internal polarity control signal POL_INT rises without any time delay. Thus, when the internal polarity control signal POL_INT goes from HIGH to LOW, the LOW signal is carried to the transmission gates TG103 and TG104 after a certain elapsed time. Consequently, the turn-on times of the transmission gates TG101/TG102 and TG103/TG104 depend on the directions of the internal polarity control signal inputted to the switching circuits SW_O and SW_E.

The reason for partly delaying the transmission gates TG101 to TG104 from being turned on through the delay elements D1 and D2 is that the NMOS transistor Q101 and the PMOS transistor Q102, which are protection devices connected to the output terminal OUT, are protected from the instantaneous high voltage generated at the moment of converting the polarities of the video signals outputted from the switching circuits SW_O and SW_E.

Figure 9A:
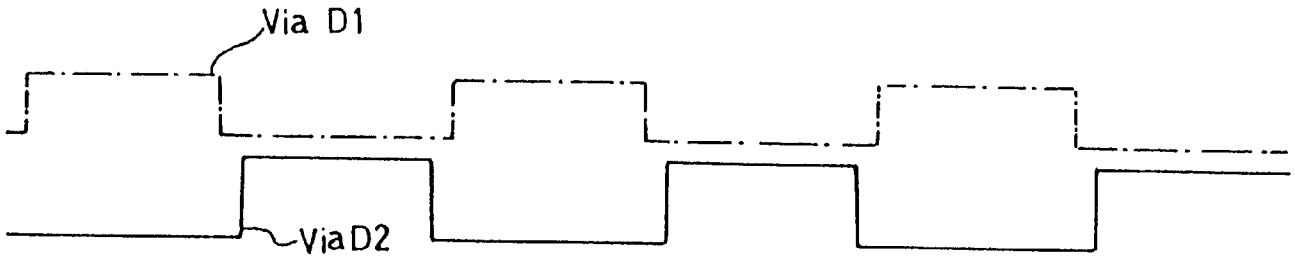
FIGS. 9A to 9C show waveforms of the input and the output signals of the switching circuit according to the present invention.
Figure 9B:
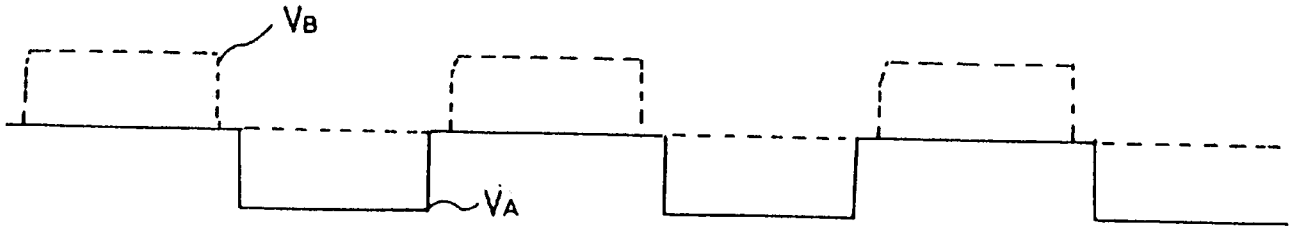
Figure 9C:
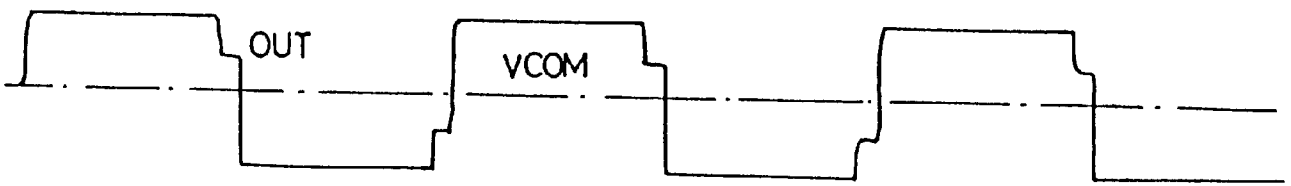

FIGS. 9A to 9C show waveforms of the input and the output signals of the switching circuit according to the present invention, where the operational characteristics of the switching devices SW_O and SW_E are shown. FIG. 9A shows the waveforms of the internal polarity control signal POL_INT applied to the transmission gate through the delay elements D1 and D2. FIG. 9B shows the voltages of nodes A and B. FIG. 9C shows the voltage of the output terminal OUT. As shown in FIG. 9A, there is a certain interval where both signals outputted from the delay elements D1 and D2 are LOW. This interval of LOW signals occurs during every transition of the internal polarity control signal POL_INT. The length of the LOW interval depends on the delaying functions of the delay elements D1 and D2. At least one of the transmission gates TG102 and TG104 is turned on in the interval where all the signals from the delay elements D1 and D2 are LOW.

The transmission gates TG101 and TG104 are turned on when the internal polarity control signal POL_INT goes from LOW to HIGH. The transmission gate TG101 turns on somewhat late due to the delay of the delay element D1, while the transmission gate TG104 is turned on as soon as the internal polarity control signal POL_INT starts its logic transition. The transmission gate TG104 is turned on faster than the precharge time of a node B to 5V, which is the level of the common voltage Vcom. During this time, the voltage of the positive polarity analog video signal is outputted from the output terminal OUT according to the dot inversion method.

Unless the node B is precharged to the common voltage Vcom, the expected life span of the PMOS transistor Q102 fabricated by a conventional CMOS process is greatly shortened by the large voltage difference (about 10V) between its drain and its source, because the voltage difference between the drain and the source becomes the difference between the positive polarity analog video signal having a maximum value of 10V and the negative polarity analog video signal having minimum value of 0V. In this case, the negative polarity analog video signals are transmitted to the output terminal OUT through the NMOS transistor Q101, since the transmission gate TG101 has turned on. Thus, the voltage difference between the source and the drain of the PMOS transistor Q102 is reduced to a voltage difference between the negative polarity analog video signal and the common voltage Vcom, where the minimum value of the negative polarity analog video signal is 0V, and the common voltage Vcom is 5V. Accordingly, the PMOS transistor Q102 is protected from damage due to high voltage.

On the other hand, when the internal polarity control signal POL_INT goes from HIGH to LOW, the transmission gates TG102 and TG103 are turned on. However, the transmission gate TG103 is turned on after a certain time has elapsed due to the delaying function of the delay element D2. The transmission gate TG102 is turned on as soon as the logic transition of the internal polarity control signal POL_INT occurs. The transmission gate TG102 is turned on before the transmission gate TG103 precharges the node A up to the common voltage level of 5V. During this time, the voltage of the negative polarity analog video signal is outputted according to the dot inversion characteristics of the source driver of the invention.

Unless the node B is not precharged to the common voltage level of 5V, the voltage difference between the drain and the source of the NMOS transistor Q101 becomes the voltage difference between the positive polarity analog video signal (up to 10V) and the negative polarity analog video signal from (0V). Accordingly, the expected life span of the NMOS transistor Q101 fabricated by a conventional CMOS process is reduced by the high voltage difference of 10V between its drain and source.

When the node A is precharged to the common voltage level Vcom of 5V, the transmission gate TG103 is turned on. Then, positive polarity analog video signals are carried to the output terminal OUT through the PMOS transistor Q102. Subsequently, the voltage difference between the source and the drain of the NMOS transistor Q101 is reduced to the voltage difference between the positive polarity analog video signal (up to 10V) and the common voltage Vcom (5V). Accordingly, the NMOS transistor Q101, similar to the PMOS transistor Q102, is protected from damage due to high voltage.

In generating video signals having opposite polarities for driving two adjacent channels, the present invention reduces the number of components needed for processing video signals by using a single video signal processing path instead of a negative polarity video signal processing path and a positive polarity video signal processing path, and prevents the protection devices in the output terminals of the output buffer from being supplied with instantaneous high voltage by precharging the last output terminal of the output buffer to the common voltage level Vcom of the positive and the negative polarity video signal.

While the invention has been described in detail and with reference to specific embodiments thereof, it will be apparent to those skilled in the art that various changes and modifications can be made therein without departing from the spirit and scope thereof. Thus, it is intended that the present invention cover the modifications and variations of this invention provided they come within the scope of the appended claims and their equivalents.

What is claimed is:

1. An LCD source driver having a plurality of driving channels comprising:

a control logic responsive to an internal polarity control signal, a first clock signal and a second clock signal, the control logic being inputted alternately and consecutively with digital video signals of multiple bits including odd channel digital video signals and even channel digital video signals, the control logic generating the odd channel digital video signals and the even channel digital video signals corresponding to a logic value of the internal polarity control signal in one of an inputted order and a reversed order;

a shift register being activated successively and outputting a plurality of enabling signals;

a latch block having a plurality of latches for receiving the odd channel digital video signals and the even channel digital video signals synchronized by the plurality of enabling signals, the latch block generating simultaneously the odd channel digital video signals and the even channel digital video signals when the enabling signals are activated;

a negative polarity video signal processor for converting the odd channel digital video signals outputted from the latch block into negative polarity analog video signals having a voltage lower than a common voltage and increased current driving capacity;

a positive polarity video signal processor for converting the even channel digital video signals outputted from the latch block into positive polarity analog video signals having a voltage higher than the common voltage and having a higher current driving capacity; and a switching block having a plurality of switching circuits for receiving the negative polarity analog video signals and the positive polarity analog video signals, wherein odd switching circuits of the switching block generate the positive polarity analog video signals on HIGH of the internal polarity control signal and the negative polarity analog video signals on LOW of the internal polarity control signal, and wherein even switching circuits of the switching block generate the negative polarity analog video signals on HIGH of the internal polarity control signal and the positive polarity analog video signals on LOW of the internal polarity control signal.

2. The LCD source driver according to claim 1, wherein the control logic further includes:

a first latch for receiving and storing the digital video signals on a falling edge of the first clock signal, the first latch outputting the digital video signals on a rising edge of the first clock signal;

a second latch for receiving and storing the digital signals outputted from the first latch on the falling edge of the second clock signal, the second latch generating the stored digital video signals on the rising edge of the second clock signal;

a third latch for receiving and storing digital video signals outputted from the first latch on the falling edge of the first clock signal, the third latch generating the stored digital video signals on the rising edge of the first clock signal;

a fourth latch for receiving and storing digital video signals outputted from the third latch on the falling edge of the second clock signal, the fourth latch generating the stored digital video signals on the rising edge of the second clock signal; and a multiplexer for receiving the digital video signals outputted from the first and the fourth latch, the multiplexer outputting the digital video signals inputted from the fourth latch when a logic value of the internal polarity control signal is 0, the multiplexer outputting the digital video signals inputted from the second latch when a logic value of the internal polarity control signal is 1.

3. The LCD source driver according to claim 2, wherein a period of the second clock signal is twice as long as a period of the first clock signal.

4. The LCD source driver according to claim 2, wherein a period of the second clock signal is the same as a period of the internal polarity control signal.

5. The LCD source driver according to claim 1, wherein the negative polarity video signal processor further includes:

a negative polarity level shifter for converting the odd channel digital video signals outputted from the latch block into negative polarity digital video signals having a lower voltage than the common voltage, the negative polarity level shifter outputting the negative polarity digital video signals;

a negative polarity digital-to-analog converter for receiving and converting the negative digital video signals outputted from the negative polarity level shifter into negative polarity analog video signals, the negative polarity digital-to-analog converter outputting the negative polarity analog video signals; and a negative polarity buffer for increasing current driving capacity of the negative polarity analog video signals, the negative polarity buffer outputting the negative polarity analog video signals with higher current driving capacity.

6. The LCD source driver according to claim 1, wherein the positive polarity video signal processor further includes:

a positive polarity level shifter for converting the even channel digital video signals outputted from the latch block into positive polarity digital video signals having higher voltage than the common voltage, the positive polarity level shifter outputting the positive polarity digital video signals;

a positive polarity digital-to-analog converter for receiving and converting the positive digital video signals outputted from the positive polarity level shifter into positive polarity analog video signals, the positive polarity digital-to-analog converter outputting the positive polarity analog video signals; and a positive polarity buffer for increasing current driving capacity of the positive polarity analog video signals, the positive polarity buffer outputting the positive polarity analog video signals with higher current driving capacity.

7. The LCD source driver according to claim 5, wherein the negative polarity buffer includes a current amplifier having a unity voltage gain.

8. The LCD source driver according to claim 6, wherein the positive polarity buffer includes a current amplifier having a unity voltage gain.

9. The LCD source driver according to claim 5, wherein a level shifter block is formed by combining the negative polarity level shifter with a positive polarity level shifter.

10. The LCD source driver according to claim 6, wherein a level shifter block is formed by combining the negative polarity level shifter with a positive polarity level shifter.

11. The LCD source driver according to claim 5, wherein the digital-to-analog converter block is formed by combining the negative polarity digital-to-analog converter with a positive polarity digital-to-analog converter.

12. The LCD source driver according to claim 6, wherein the digital-to-analog converter block is formed by combining the negative polarity digital-to-analog converter with a positive polarity digital-to-analog converter.

13. The LCD source driver according to claim 5, wherein a buffer block is formed by combining the negative polarity buffer with a positive polarity buffer.

14. The LCD source driver according to claim 6, wherein a buffer block is formed by combining the negative polarity buffer with a positive polarity buffer.

15. The LCD source driver according to claim 1, wherein the switching block further includes:

a first transmission gate for receiving negative polarity analog video signals outputted from the negative polarity video signal processor, the first transmission gate turning on when a logic value of the internal polarity control signal is 0;

a second transmission gate for receiving the common voltage, the second transmission gate turning on when a logic value of the internal polarity control signal is 1;

an NMOS transistor controlled by the common voltage, wherein a source of the NMOS transistor is supplied with output signals from the first transmission gate and from the second transmission gate;

a third transmission gate for receiving positive polarity analog video signals outputted from the positive polarity video signal processor, the third transmission gate turning on when a logic value of the internal polarity control signal is 1;

a fourth transmission gate for receiving the common voltage, the fourth transmission gate turning on when a logic value of the internal polarity control signal is 0; and a PMOS transistor having a source for receiving output signals of the third transmission gate, and the fourth transmission gate, and having a gate being controlled by the common voltage.

16. The LCD source driver according to claim 1, wherein the switching block further comprises a plurality of switching circuits, each switching circuit including:

a first transmission gate for receiving the internal polarity control signal through a first delay element and a second delay element connected in parallel, the first transmission gate also receiving negative polarity analog video signals outputted from the negative polarity video signal processor, the first transmission gate turning on when a logic value of an output of the first delay element is 0;

a second transmission gate for receiving the common voltage, the second transmission gate turning on when a logic value of output signal of the first delay element is 1;

an NMOS transistor having a source for receiving output signals of the first transmission gate and of the second transmission gate, and having a gate being controlled by the common voltage;

a third transmission gate for receiving positive polarity analog video signals outputted from the positive polarity video signal processor, the third transmission gate turning on when a logic value of an output of the second delay element is 1;

a fourth transmission gate for receiving the common voltage, the fourth transmission gate turning on when a logic value of an output of the second delay element is 0; and a PMOS transistor having a source of the PMOS transistor for receiving output signals of the third transmission gate and of the fourth transmission gate, and having a gate being controlled by the common voltage.

17. The LCD source driver according to claim 16, wherein the first delay element increases the rise time of the internal polarity control signal.

18. The LCD source driver according to claim 16, wherein the first delay element does not affect the fall time of the internal polarity control signal.

19. The LCD source driver according to claim 16, wherein the second delay element increases the fall time of the internal polarity control signal.

20. The LCD source driver according to claim 16, wherein the second delay element does not affect the rise time of the internal polarity control signal.

* * * * *